United States Patent [19]

Spaulding et al.

[11] 4,080,800

[45] Mar. 28, 1978

[54] CRYOGENIC CIRCUIT

[75] Inventors: Roy H. Spaulding; Fred P. Snyder, both of St. Louis County, Mo.

[73] Assignee: Essex Cryogenics Industries, Inc., St. Louis, Mo.

[21] Appl. No.: 650,166

[22] Filed: Jan. 19, 1976

[51] Int. Cl.[2] ..... F17C 7/02

[52] U.S. Cl. ..... 62/51; 62/55; 137/539.5

[58] Field of Search ..... 62/50, 51, 55; 137/111, 137/114, 539.5

[56] References Cited

U.S. PATENT DOCUMENTS

| | | | |
|---|---|---|---|
| 2,481,713 | 9/1949 | Bertea | 137/539.5 |
| 2,645,906 | 7/1953 | Ryan | 62/51 |
| 2,916,061 | 12/1959 | Hahn et al. | 62/51 |
| 2,958,204 | 11/1960 | Spaulding | 62/51 |
| 2,964,919 | 12/1960 | Howlett | 62/52 |
| 3,018,635 | 1/1962 | Keckler | 62/51 X |
| 3,151,640 | 10/1964 | Teston | 62/50 X |

*Primary Examiner*—Ronald C. Capossela
*Attorney, Agent, or Firm*—Ralph W. Kalish

[57] ABSTRACT

A cryogenic circuit which comprises a tank for the liquid and vapor phase of the cryogen; there being a flow control valve connected at opposite ends to the liquid and vapor sides of said tank with a check valve being interposed between said vapor side and said flow control valve. The flow control valve contains a single outlet orifice directly connected to the vapor inlet. A valve arrangement is interposed between the liquid inlet of the said flow control valve and its single outlet; said valve arrangement comprising a ball valve with associated components between same and the liquid inlet to cause said valve to operate as a control valve and with a spring bearing against the upper side of said ball to adapt same for check valve usage when the associated control valve components are withdrawn under predetermined pressure conditions.

10 Claims, 5 Drawing Figures

CRYOGENIC CIRCUIT

BACKGROUND AND SUMMARY OF THE INVENTION

This invention relates to fuel systems and, more particularly, to a circuit for delivery of a cryogen in such systems.

Heretofore in cryogenic circuits involving the customary liquid and vapor phase operating modes, it has been customary to incorporate a solenoid valve for the liquid portion of a circuit and a second valve for the vapor side of the circuit with said valves being triggered by a pressure switch which is controlled by the particular operating mode. Generally, with relatively low pressure the pressure switch would cause energization of the solenoid valve in the liquid portion of the circuit for permitting liquid flow, and at a relatively elevated pressure the switch would cause energization of the other solenoid valve so as to allow for vapor phase flow. One of the most serious drawbacks to this earlier effort was that often the vapor phase flow alone did not provide adequate supply flow and since the solenoids were mutually independent or isolated, there would occur systematically supply line starvation during the vapor phase flow. Another earlier effort constituted a system having provision for liquid withdrawal only for the storage tank, there being no control valves other than safety relief valves. In systems of the present invention for effective operation it is requisite that there be means for permitting both vapor phase flow and liquid phase flow and concurrent flow of both vapor and liquid to meet high supply demands.

Therefore, it is an object of the present invention to provide a cryogenic circuit which is adapted to uniquely permit liquid phase flow simultaneously with vapor phase flow to meet high supply demands.

It is another object of the present invention to provide a cryogenic circuit which operates in an automatic fashion under fluid pressure so that the provision of liquid to the flow path during the vapor phase operating mode is brought about through a most reliable and yet simple operation which is devoid of pressure switches, solenoid valves, and the like.

It is another object of the present invention to provide a cryogenic circuit of the type stated wherein the liquid phase and vapor phase flows are fed through a common conduit to a feed or supply line so that the said phases are not isolated.

It is another object of the present invention to provide a control flow valve for use in a cryogenic system which is adapted for connection to both a source of vapor and source of liquid and incorporating unique valve means for allowing individual or combined flow therethrough responsive to pneumatic forces.

It is a further object of the present invention to provide a valve of the character stated which contains a single outlet orifice for both liquid phase and the vapor phase.

It is a further object of the present invention to provide a valve of the character stated which embodies a valve arrangement adapted under one set of circumstances to operate as a control valve and under other conditions to operate as a customary check valve.

It is a still further object of the present invention to provide a system of the character stated which contains a limited number of components which are of sturdy wear-resistant construction; which system is durable and reliable is usage; and which is both economical in manufacture, as well as in operation.

DESCRIPTION OF THE PREFERRED EMBODIMENT

Figure 1:
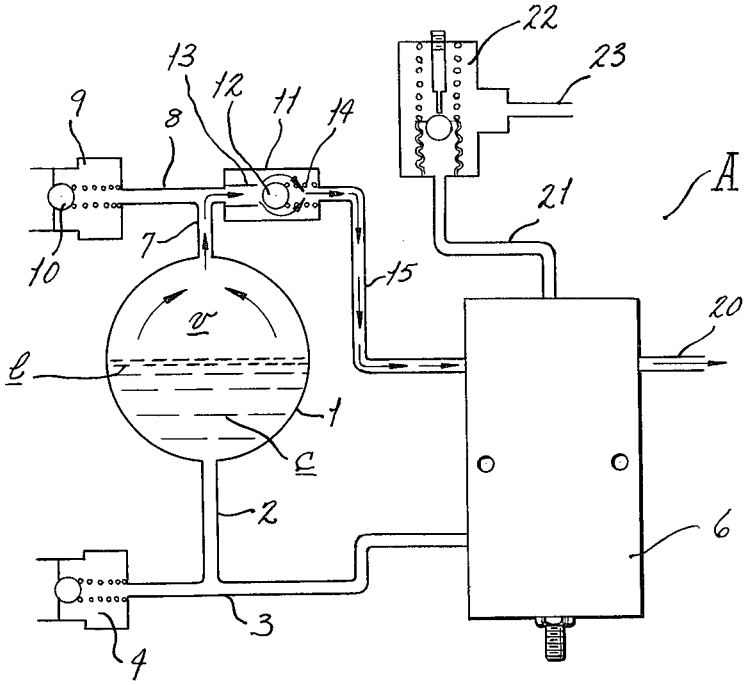
FIG. 1 is a schematic view of a cryogenic circuit constructed in accordance with and embodying the present invention.
Figure 2:
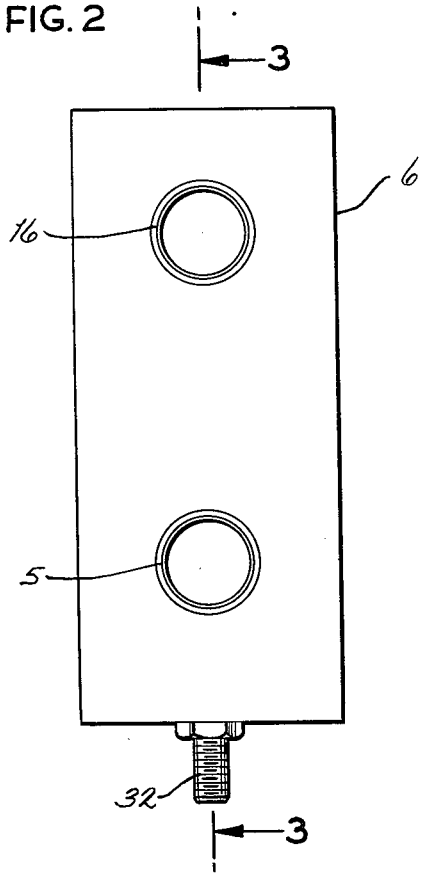
FIG. 2 is an enlarged view of the valve housing as taken from the left hand side of said housing in FIG. 1.

Referring now by reference numerals to the drawings which illustrate the preferred embodiment of the present invention, A generally designates a circuit for delivery of a cryogen from a point of storage to a point of application, such as, for instance, an engine (not shown) for vehicular or other usage. The circuit incorporates a storage tank 1 for the selected cryogen *c*, which may be internally insulated in accordance with techniques well known in the art to conduce to maintenance of the contained cryogen in a liquid state. Tank 1 is connected at its lower end by a conduit 2 to a liquid delivery pipe 3 which at one end is provided with a conventional fill valve 4 for connection to a source of supply of the cryogen when required, and with the other end of said pipe 3 being connected to an inlet port 5 provided in the lower portion of a flow control valve 6, having a body 6'. At its upper end said tank 1 is in communication by means of a conduit 7 which may be axially aligned with conduit 2 to a vapor outlet pipe 8; which latter at one end is engaged to the usual vent valve 9; the same, for purposes of exposition only, being shown as incorporating a spring-pressed ball valve 10. In its opposite end portion said valve outlet pipe 8 is connected to one end of a check valve 11 which for purposes of illustration only incorporates a ball 12 urged against a seat 13 by a spring 14 engaging the ball on its side remote from the connection to pipe 8. Extending between check valve 11 and flow control valve 6, is a conduit 15, the outer or check valve remote end of which engages a port 16 in the upper portion of said valve control body 6' which is shown in vertical alignment with the connection of pipe 3. It will thus be seen that the liquid phase 1 of cryogen *c* will through gravity be disposed in the lower portion of tank 1 and be flowable within conduit 2 and pipe 3, while the vapor phase *v* of cryogen *c* will be flowable through conduit 7, pipe 8, and conduit 15.

Figure 5:
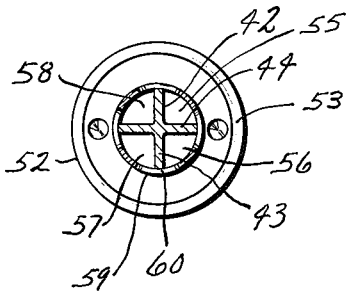
FIG. 5 is a transverse sectional view taken on the line 5—5 of FIG. 4.

Flow control valve body 6' is of generally blocklike character being provided with an axial bore and a multiplicity of counterbores to provide the requisite internal configuration for accommodating the valve components in their peculiar operative arrangement to be described more fully hereinbelow. Therefore, there is an upper chamber 17 through which opens a transverse passage 18, the inner end of which is constituted of port 16 and the outer end of which comprises an outlet port 19 connected to a feed line 20 which is operatively connected to the remotely located zone of fuel expenditure (not shown), such as an engine, etc. Chamber 17 at its upper end is in communication with a feed line 20 opening through the upper end of body 6' for connection to one end of a conduit 21, the other end of which opens into the bottom of a relief valve illustrated schematically at 22 and which latter is connected to the usual overboard vent 23. Downwardly of chamber 17 is a main compartment 24 of relatively increased cross section which in its lower end portion communicates with port 5 through a short passage 25. The lower end of compartment 24 is defined by the diametrally enlarged annular base flange 26 of a bellows 27, said base flange abutting against a downwardly directed shoulder 28 formed in body 6', and with the said flange 26 abutting tightly upon the annular upper face of a base closure 29 threadedly engaged within a bottom recess 30 formed in valve body 6' by counterboring as above suggested. Said closure 29 is centrally drilled and tapped, as at 31, for receiving an adjustment screw 32, the upper end of which projects into a central upwardly opening recess 33 formed in said closure 29 for reception of the upper end of said screw within a complementarily formed, downwardly opening recess or indentation 34 provided in a cap-like spring spring bearing 35. Said spring bearing 35 embodies a radial flange 36 against the upper face of which bears the lower end of a compression spring 37 extending upwardly within bellows 27 and abutting at its upper end against the under face of an end plate 38 provided at the upper end of bellows 27; there being integral with said plate 38 a central downward extension 39 for extension within the upper portion of spring 37 for directing purposes. Extension 39 is bored to provide a socket 40 for receiving a tang 41 at the lower end of an upwardly extending valve stem 42, said stem being rigid with plate 38 and, hence, bellows 27, as by brazing, adhesives, etc. As may best be seen in FIG. 5, valve stem 42 is of general cruciform in cross section having intersecting arms 43, 44 for purposes presently appearing. At their upper ends arms 43,44 are downwardly inclined, as at 45, at an angle suitable to provide a support for ball valve 46. Engaging the upper portion of ball valve 46 in urging same downwardly is a coil spring 47, the upper end of which spring bears against a downwardly directed shoulder 48 formed in valve body 6' as by suitable counterboring as above pointed out.

Surrounding the upper valve seat-forming end of stem 45 is an annulus 49 which on its upper surface abuts against a downwardly directed shoulder 50 provided in valve body 6' and which annulus in its inner upwardly directed portion mounts a gasket or liner 51 of suitable wear-resistant material defining a seat for ball valve 46. The under face of annulus 49 abuts the upper face of a guide or retainer 52 having a circular, externally threaded body 53 engaging internal threads formed on the confronting portion of the inner wall of main compartment 24. Centrally, guide 52 is provided with a bore 54 for receiving the adjacent portion of stem 42 having but a slightly greater diameter than the major cross section of said stem 42 to permit of relative movement therebetween resulting from extension or contraction of bellows 27, as will be shown hereinbelow. However, said bore 54 cooperates with stem arms 44,43 to define four discrete flow passageways 55,56,57,58 (see FIG. 5) whereby flow of liquid therethrough may move past ball valve 46 when bellows 27 is fully extended by spring 37, in which condition stem 42 will be projected upwardly of valve seat 51 whereby liquid may flow easily from chamber 24 through compartment 17 and out orifice 19. Said guide or retainer 52 incorporates a short depending sleeve portion 59 having the same inside diameter as bore 54 and being provided in its wall with four equi-spaced openings 60 each for communicating with passageways 56,57,58,59.

Base closure 29 is provided in its bottom wall with an opening 61 which connects the atmosphere with the interior of bellows 27 through recess 33.

In operation, circuit A is designed to be primarily in the liquid phase operating mode, that is, with flow of liquid 1 from the lower portion of tank 1 through control valve 6 to feed line 20 for the particular intended purpose. The withdrawal of liquid from tank 1 is to be desirably effected at relatively low pressure, as for example, at or about 35 psi; but with such obviously being a matter of choice. Spring 37 acts upon bellows 27 for carrying stem 42 with ball valve 46 upwardly above its seat as developed by gasket 51. The strength of spring 37 is, expectedly, determined by the desired pressure under which the associated valve structure acting as a control valve will be open so that the liquid will flow at or below the preselected pressure and with stem 42 and ball valve 46 being thus held in raised or open condition by expansion of bellows 27. In the present instance, with the exemplary pressure of 35 psi spring 37 is unstressed and maintains stem 42 and valve 46 so that liquid may move through passage 25, into compartment 24 through openings 60 and thence into passageways 55, 56, 57, 58, past ball valve seat 51, thence into chamber 17, and outwardly through transverse passage 18 into feed line 20. During the liquid phase flow control valve 6 is thus in fully open condition for such flow and any vapor phase flow during the liquid phase operating mode is prevented by operation of check valve 11. Said valve 11 which is illustrated as being of the spring-loaded type has a spring of such strength as to resist unseating of its ball 12 during liquid phase flow under the relatively low pressure indicated whereby liquid phase flow is the preferential flow in the operation of the present invention.

Figure 3:
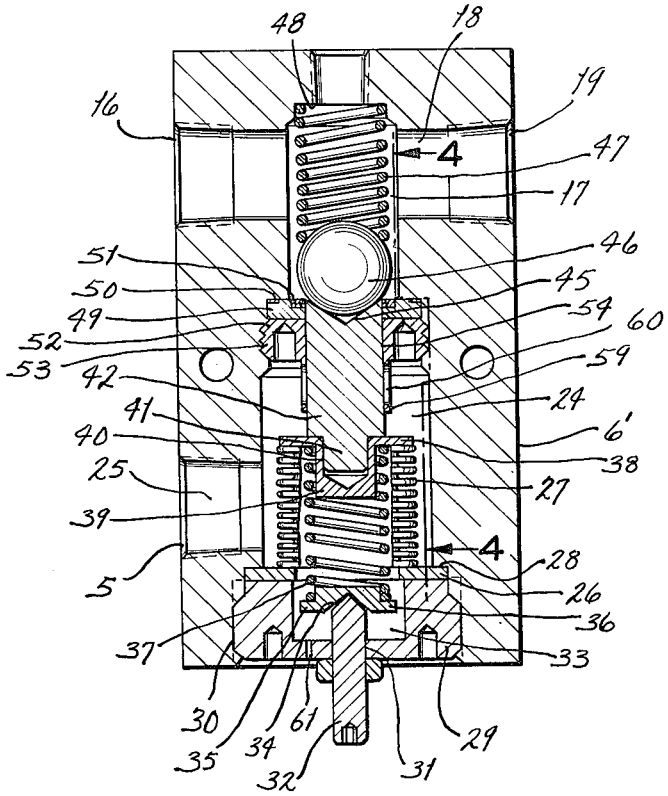
FIG. 3 is a vertical transverse sectional view taken on the line 3—3 of FIG. 2.
Figure 4:
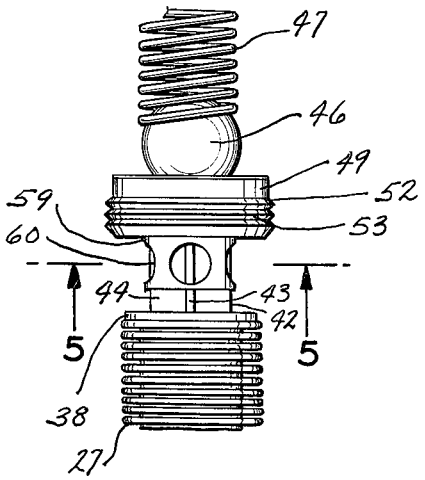
FIG. 4 is a vertical view taken on the line 4—4 of FIG. 3.

However, the vapor pressure within tank 1 may during certain periods increase such as by means of vaporization of the liquid by normal heat reflux through the tank walls, so that with the developed vapor pressure spring 14 of check valve 11 is overcome whereby the related ball 12 is unseated and a vapor phase operating mode is developed with the vapor moving through conduit 15 and into transverse passage 18 of flow control valve 6 wherein it will cause to be applied sufficient pressure against ball valve 46 to drive same downwardly onto its gasket-forming seat 51 together with stem 42, due to the compression of spring 37 with the engaged bellows 27 being in commensurately contracted condition as shown in FIG. 3. Thus, in such state it is conceivable that the liquid pressure acting on spring 37 through bellows 27 may not be of sufficient strength to force further contraction of said bellows 27. Therefore, ball valve 46 will be held in closed condition inhibiting liquid phase flow during the vapor phase operating mode, such, of course, being conditioned upon the assumption that the pressure within the supply or feed line 20 is maintained at a sufficiently high level to prevent upward movement of ball valve 46 under the particular liquid pressure. Nevertheless, it is to be understood that with the elevation of the vapor pressure there will obviously be relatively increased pressure against liquid 1 within tank 1 and which pressure will be transferred by the liquid to chamber 24 so that spring 37 together with bellows 27 will be forced into a contracted state thereby causing removal of stem 42 from engagement with ball valve 46. In such condition it will, therefore, be apparent that ball valve 46 will take on the characteristics of a check valve since it is operated by the overlying spring 47.

Normally the vapor phase operating mode will continue until the vapor pressure within tank 1 has dropped to that under which the liquid 1 is designed to flow. In this condition check valve 11 will return to closed state and spring 37 will be relieved of stress so as to effect an upward restoration of stem 42 above seat 51 to open ball valve 46 and thereby permit of a resumption of the liquid phase operating mode.

From the foregoing it will be seen that the circuit of the present invention is fully pneumatic, operating in an automatic manner and with the components being thus relatively few in number and of simple construction as distinguished from cryogenic delivery circuits heretofore known which have involved a multiplicity of complex components such as solenoid valves, pressure switches, and the like.

Of extreme importance is the fact that the circuit of the present invention in addition to providing for independent liquid phase and vapor phase withdrawal from tank 1, also uniquely permits of supplemental liquid phase flow during periods of high supply demand during the vapor phase operating mode. In such periods the feed or supply line pressure may drop below the storage tank pressure so that although the vapor pressure within tank 1 is of sufficient force to open check valve 11 and permit of vapor phase flow, the drop in the feed or supply line pressure is such as to create a marked differential between the pressure within passage 18 and that of compartment 24 which latter is caused by the expected relatively elevated liquid pressure so that such liquid pressure will overcome spring 47 and thereby force ball 46 upwardly to allow liquid to also move into passage 18 with the vapor. As suggested hereinbelow, in this particular state with stem 42 held downwardly under the increased liquid pressure ball valve 46 acts as a check valve and the same is opened through the pressure differential between that of the liquid and the relative reduction in the supply or feed line. Accordingly, in this condition the present invention permits of a simultaneous flow of liquid and vapor and prevents the customary line starvation which occurs in current structures during the vapor phase operating mode. Thus, the supplemental liquid assures of appropriate provision of fuel for the intended purpose and provides a safety factor heretofore unknown in the industry. From the foregoing it is thus apparent that control valve 6 has the capacity of, in effect, serving both as a control valve and a check valve.

In passing, it might be stated that check valve 11 provides two critical functions; one being the obvious restriction to vapor flow during the liquid phase operating mode as previously described, and the other being to prevent the flow of liquid therethrough and, hence, into flow control valve and with discharge through venting through vent valve 9 during filling rather than retention within the storage tank 1.

Having described our invention, what we claim and desire to obtain by Letters Patent is:

1. A cryogenic system comprising means defining a tank for receiving a fluid having a liquid phase and a vapor phase, a flow control body, means connecting the liquid side of said tank with a first inlet in said flow control body, means connecting the vapor side of said tank with a second inlet in said flow control body, said flow control body having a single outlet, there being a passage within said flow control body connecting said outlet with said second inlet, said body having a liquid flow path between said first and second inlets and said passage, said liquid flow path including a chamber, and fluid-pressure responsive valve means disposed in said chamber for controlling flow within said liquid flow path, said fluid-responsive pressure valve means comprising an annular valve seat disposed in said chamber, a ball valve disposable upon said seat, a valve stem disposed in said chamber and having an upper end projectable upwardly through said valve seat and engageable with the under portion of said valve ball, and first resilient means provided in said control body operatively engaging said valve stem for urging said ball from its seat to permit liquid flow through said chamber and said passage to said outlet.

2. A cryogenic system as defined in claim 1 and further characterized by said means connecting the vapor side of said tank with the second inlet of said control body comprising a first conduit connected at its tank remote end to the upper end portion of said control body.

3. A cryogenic system as defined in claim 1 and further characterized by there being a check valve provided within said first conduit between the vapor side of said tank and the connection of said first conduit to said flow control body, said check valve being normally closed and operable at a preselected vapor pressure to permit vapor flow from said tank to said flow control body.

4. A cryogenic system as defined in claim 1 and further characterized by said means connecting the liquid side of said tank with the first inlet of said control body comprising a second conduit connected at its tank remote end to the lower portion of said control body.

5. A cryogenic system as defined in claim 1 and further characterized by said fluid-responsive pressure valve means also comprising second resilient means extending across said passage and projecting into said flow path and being engageable with the upper portion of said ball valve for urging same downwardly onto said seat.

6. A cryogenic system as defined in claim 1 and further characterized by an expansible and contractible bellows enclosing said first resilient means, means operatively engaging said bellows with said stem whereby when subjected to a predetermined liquid pressure said bellows are contracted for stressing said first resilient means and causing said stem to be moved in a direction away from said valve seat.

7. A cryogenic system as defined in claim 1 and further characterized by said stem being of cruciform contour in cross-section providing a plurality of liquid passageways for establishing liquid flow therethrough when said ball valve is raised by said stem from the valve seat.

8. A cryogenic system as defined in claim 1 wherein the major axis of said passage is perpendicular to the major axis of said chamber.

9. A cryogenic system as defined in claim 6 and further characterized by said bellows in their portion remote from their operative engagement to said stem being anchored within said flow control body and means connecting the interior of said bellows with the atmosphere.

10. A cryogenic system as defined in claim 5 and further characterized by said first resilient means having such strength as when in normally unstressed condition to overcome said second resilient means when the latter is unstressed for biasing said valve into open condition for liquid flow from said chamber to said passage.

* * * * *